US007383787B2

(12) United States Patent
Flood

(10) Patent No.: US 7,383,787 B2
(45) Date of Patent: Jun. 10, 2008

(54) FOLDING BOAT

(76) Inventor: Peter Michael Flood, 9250 NC Highway 42, Holly Springs, NC (US) 27540

( * ) Notice: Subject to any disclaimer, the term of this patent is extended or adjusted under 35 U.S.C. 154(b) by 0 days.

(21) Appl. No.: 11/810,756

(22) Filed: Jun. 7, 2007

(65) Prior Publication Data

US 2007/0295261 A1 Dec. 27, 2007

Related U.S. Application Data

(60) Provisional application No. 60/812,888, filed on Jun. 12, 2006.

(51) Int. Cl.
*B63B 7/00* (2006.01)
*B63B 35/00* (2006.01)

(52) U.S. Cl. ..... 114/353; 114/347

(58) Field of Classification Search ..... 114/353
See application file for complete search history.

(56) References Cited

U.S. PATENT DOCUMENTS

| | | | |
|---|---|---|---|
| 1,359,806 A | 11/1920 | Holmstrom | |
| 1,649,311 A | 11/1927 | Kaechele | |
| 2,994,891 A | 8/1961 | Przybylski | |
| 4,004,307 A | 1/1977 | Hermann | |
| 4,057,865 A | 11/1977 | Trautwein | |
| 4,274,170 A | 6/1981 | Simpson | |
| 4,480,579 A | 11/1984 | Masters | |
| 4,841,899 A | 6/1989 | Fleckles | |
| 5,615,634 A | 4/1997 | Gonda | |
| 5,875,731 A | 3/1999 | Abernethy | |
| 6,367,405 B1 * | 4/2002 | Smiley | 114/353 |

FOREIGN PATENT DOCUMENTS

| | | |
|---|---|---|
| FR | 2572050 | 4/1986 |
| FR | 2590224 | 5/1987 |
| FR | 2756250 | 5/1998 |
| FR | 2758788 A1 | 7/1998 |
| JP | 51122299 | 10/1976 |
| JP | 60018479 | 1/1985 |
| JP | 1269691 | 10/1989 |
| JP | 1269692 | 10/1989 |
| JP | 1269693 | 10/1989 |
| JP | 7205876 | 8/1995 |
| JP | 2005335690 | 12/2005 |

OTHER PUBLICATIONS http://www.fujitacanoe.com/en/hi.htm.
The Original Floating Boat: Anatomy 101.
Feathercraft: Construction.

(Continued)

*Primary Examiner*—Jesús D Sotelo
(74) *Attorney, Agent, or Firm*—Ward and Smith, P.A.

(57) ABSTRACT

The folding boat includes bow and stern members made up of a pair of tubes connectable to each other through a pin mechanism. A polarity of chines extend the length of the boat and are made up of connected tubes which can be disconnected amidships. Cockpit tubes serve to define a cockpit region and are interconnected by hinges and by pin clips to allow folding along two axis approximating one-forth of its assembled size.

10 Claims, 12 Drawing Sheets

OTHER PUBLICATIONS

Atlatl Folding Kayaks: Assembly Manual.
Aufbauanleitung SZ2004.
Long Haul Folding Kayaks: Mark I Assembly, Care and Maintenance Classic, Expedition.
Klepper Faltboote: Assembly Maintenance All Models.
Ally Canoe: Assembly Instructions.
English translation of the Abstract for FR 2572050.
English translation of the Abstract for FR 2590224.
English translation of the Abstract for FR 2756250.
English translation of the Abstract for FR 2758788.
English translation of the Abstract for JP 1269691.
English translation of the Abstract for JP 1269692.
English translation of the Abstract for JP 1269693.
English translation of the Abstract for JP 2005335690.
English translation of the Abstract for JP 51122299.
English translation of the Abstract for JP 60018479.
English translation of the Abstract for JP 7205876.

* cited by examiner

FOLDING BOAT

CROSS REFERENCE TO RELATED APPLICATIONS

This application is related to and claims priority to Provisional Application Ser. No. 60/812,888 filed Jun. 12, 2006 and entitled, "Light, Portable, Boat that Folds Easily and Quickly" of the same inventor. Applicant hereby expressly claims priority to the filing date of said provisional application and specifically incorporates the disclosure thereof by reference in its entirety herein.

BACKGROUND OF THE INVENTION

1. Field of the Invention

This invention relates to a folding or collapsible boat that folds easily and quickly, and is light and portable to carry. More specifically, the invention relates to a light, portable, boat that folds easily and quickly within its own skin without requiring tools to assemble or disassemble the boat.

2. Discussion of Prior Art

Folding or collapsible boats are well known and most designs have been commercially available for many years. As a general rule, most of the known prior art structures are made up of a complex arrangement of stringers and formers which are joined together with latches and clamps to form a relativity loose framework in which bow and stern halves are temporarily hinged together amidships. Typically the two halves of the framework are disconnected and when assembled, are rigidly connected together inside a skin to form the assembled boat. Such designs of folding kayaks and boats when disassembled result in a large number of disconnected pieces and require a considerable amount of time to reassemble, and a set of tools. Moreover, the assembly requires skill and care in following instructions and it is not unusual to lose an important piece of the structure when assembled.

French Patent Publication No. 2,572,050 discloses a dismantlable small craft of the canoe/kayak type which includes a hull made up of a flexible envelope held in shape and in tension by a frame consisting of a set of securely fastened tubes which can be retracted, but not taken apart. However, such a structure also includes a complicated arrangement requiring a protective tube perpendicular to the length of the craft, including screw fastenings which require assembly and disassembly with tools to fold and/or assemble the boat.

An alternative design is disclosed in U.S. Pat. No. 4,274,170 which discloses a framework characterized by plural longitudinal members including forward and aft member portions, forward, aft, port and starboard chines and gunwale member portions, and forward and aft longitudinal deck members. The framework includes a cockpit structure with longitudinal members releasably interconnecting the cockpit structure with the bow and stern of the boat. The structure disclosed herein effectively permits the cockpit structure to be folded along one axis, parallel to the midportion thereof so as to bring the midportions closer together so that the kayak can be folded into a framework suitable for use as a backpack frame. Notwithstanding this folding structure, a closer review of the patent such as, for example, FIGS. 4-8 shows a series of screws, wingnuts, and other elements which need to be connected and disconnected resulting in a structure which is not easy to assemble or disassemble.

In accordance with the invention, these problems with the prior art are avoided and there is provided a folding boat with a waterproof fabric skin that sets up very quickly, is light, compact, portable, and requires little room to store when folded. Further, the need for any tools or accessories is avoided making the process of assembly that much easier.

BRIEF SUMMARY OF THE INVENTION

In one aspect, the invention is a folding boat which includes sets of bow and stern members, each set comprised of a pair of tubes connectable to each other through a pin engaging mechanism. The pin engaging mechanism is actuatable for engaging the pair of tubes to each other in a rigid configuration. A pair of gunwale chines extend the length of the boat at each side thereof. The gunwale chines have multiple segments engageable with each other and separable from each other. Tube chines also extend the length of the boat along the floor thereof, and also elevated from the floor thereof. Each one of the tube chines also have multiple segments engagable with each other and separable from each other. Cockpit tubes are engagable with each other and movable in relation thereto for defining a cockpit entry. A bow spreader, stern spreader, and center spreader are each configured for supporting and retaining the gunwale chines, tube chines and cockpit tubes in a spread, attached and fixed position. At least one, and preferably two, floorboards are removable from the boat and configured for placing on a floor cockpit region and for being retained by the bow spreader and stern spreader. A waterproof skin is supported by and surrounds the bow and stern members, gunwale chines, tube chines, cockpit tubes, bow spreader, center spreader, stern spreader and floorboards which engage in a tensioned condition, and when not engaged in a tensioned condition, allow the boat to be folded along two axes within the waterproof skin.

In one specific aspect, the cockpit tubes are both hinged with respect to each other to allow both folding and separation from each other. Yet still further, the waterproof skin includes sleeves, for example, for holding the various tubes of the boat engaged therewith in a position for assembling the boat from a folded condition and for holding the tubes in proper spaced relationship for engagement with the spreaders. Yet still further, the combination of hinges, both amidships and longitudinally, allow for proper tension of the fabric skin surrounding the tubular inner structure. Yet still further, the invention includes a matching carrying bag for carrying the boat when folded along its two axes as well as the 4-5 parts required for assembly.

As may be appreciated, in accordance with the structure described herein, the folding or collapsible boat can be assembled or disassembled in a short amount of time. Further, no tools or pumps are needed to assemble or disassemble the boat, and the boat is easy and quick to assemble, only 4-5 parts are added to make this happen. Due to the use of plastic tubing and lightweight metal materials, the boat is light and because the boat can be folded along two axis, it is less than one-forth of its assembled size when folded.

BRIEF DESCRIPTION OF THE DRAWINGS

Having thus generally described the invention, the same will become better understood from the following detailed discussion, made with reference to the appended drawing, wherein.

DETAILED DISCUSSION

Figure 1:
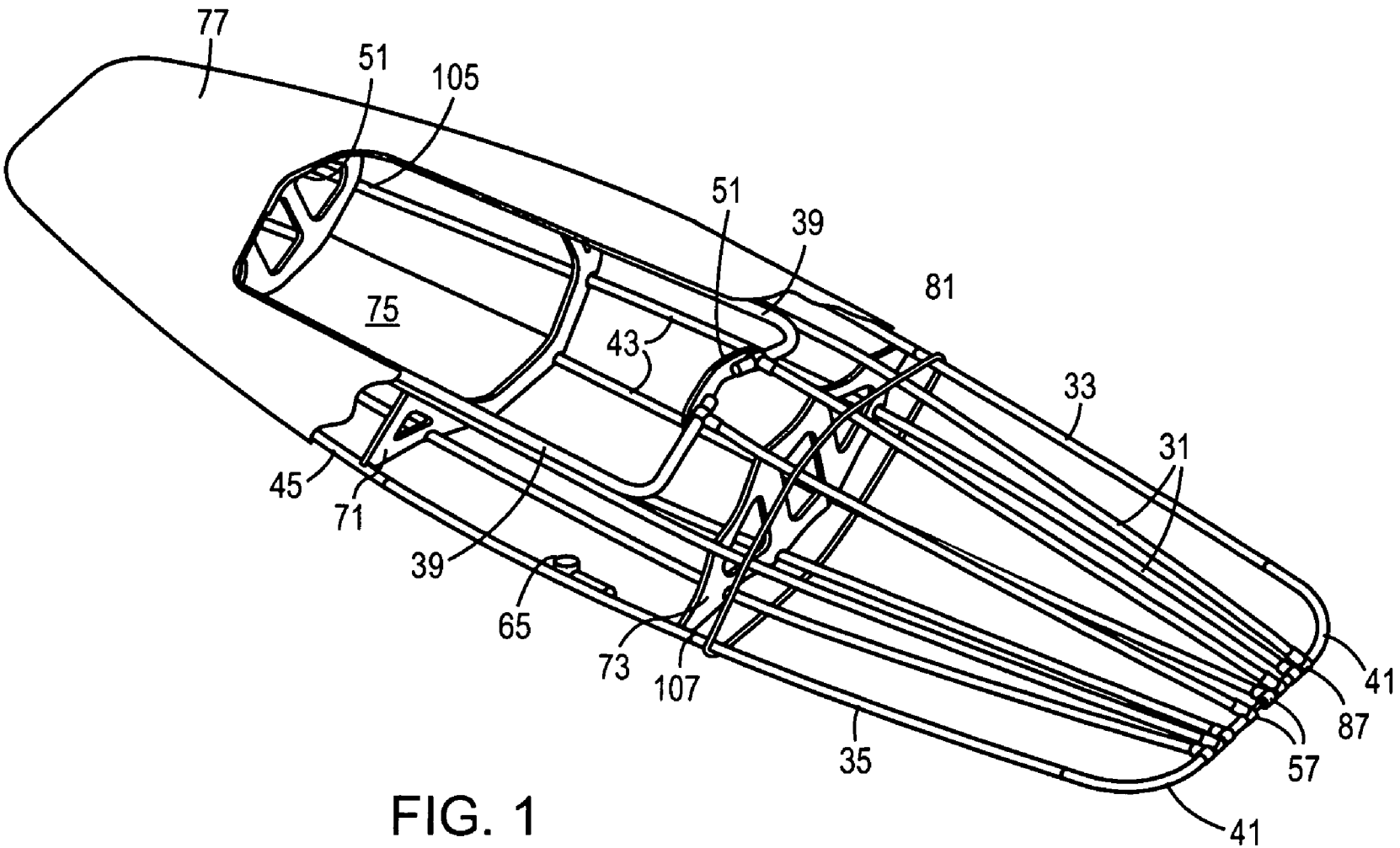
FIG. 1 is a perspective view of a fully assembled boat with part of the fabric skin removed to allow viewing of internal parts.
Figure 2:
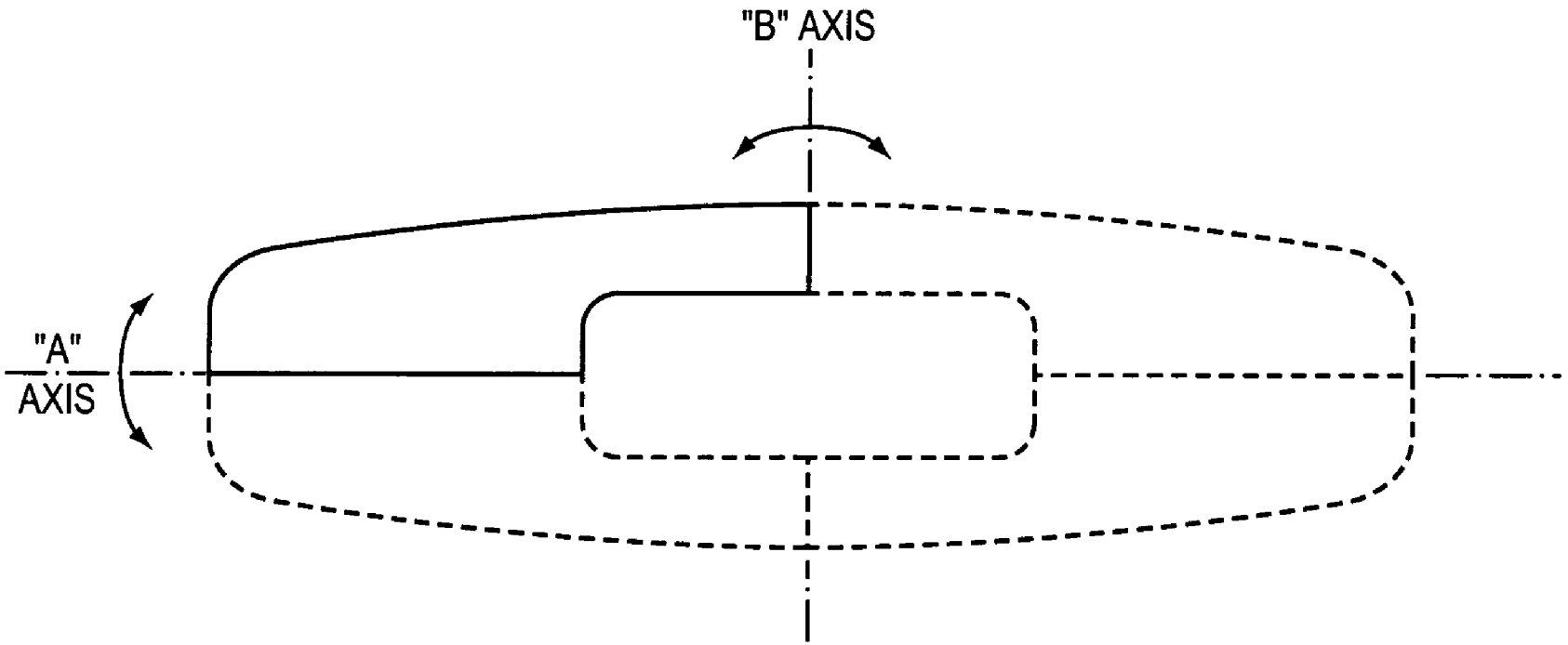
FIG. 2 is a top schematic plan view illustrating the two folding axes for the boat.
Figure 9:
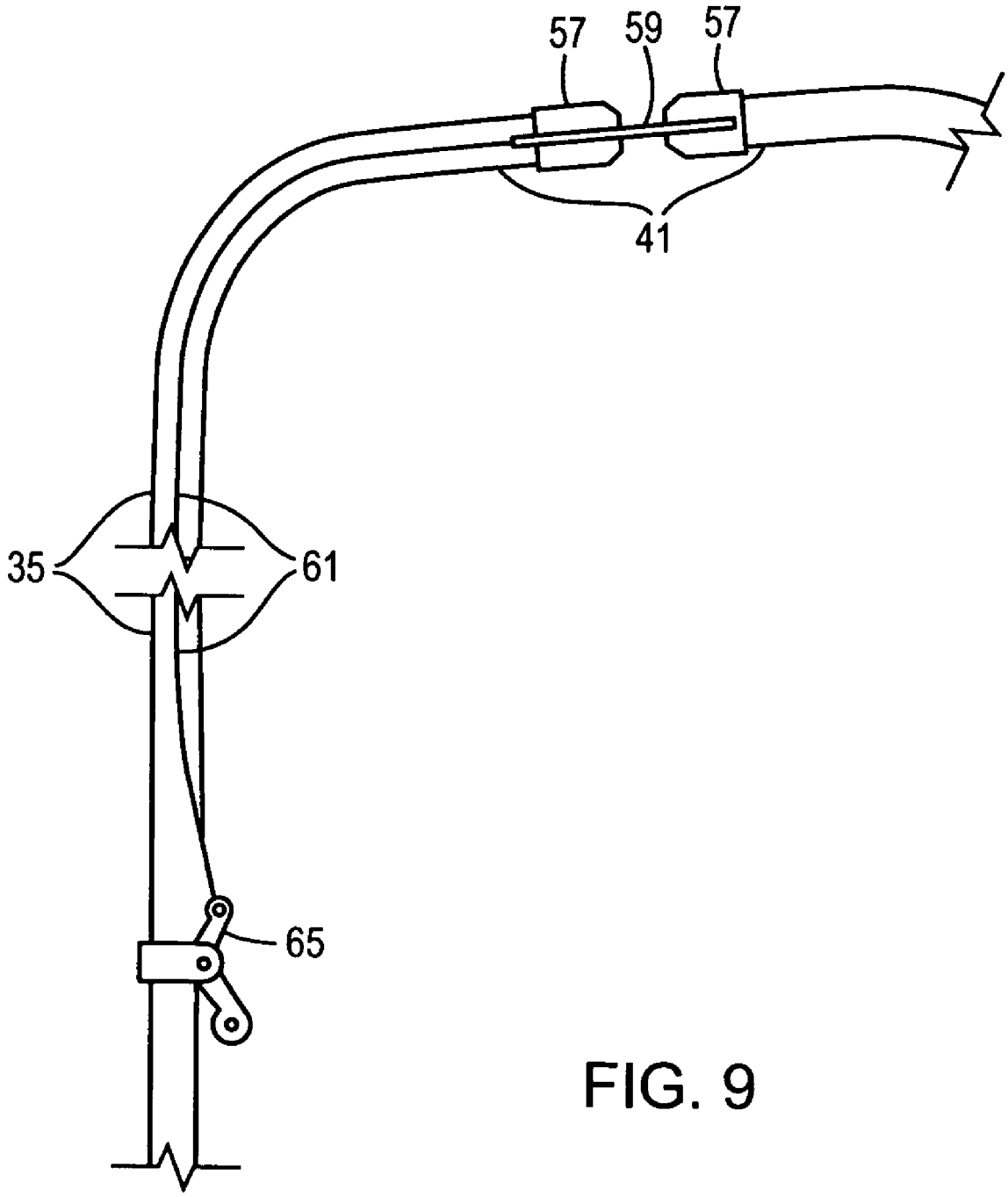
FIG. 9 is a detailed partial view of the fabric skin's tensioning system including a lever, rod and pin arrangement which when retracted allows the boat to be folded along the A axis.

FIG. 1 shows a folding boat in accordance with the invention, with part of its outer skin fabric 77 removed. As may be appreciated from FIG. 1 and from FIG. 9, a pair of bow tubes and stern tubes 41 are respectively located at the stern and bow. Tension levers 65, as shown in FIG. 9, connect the tension rods 61 to a tension pin 59 at both the stern and the bow. Tension pin inserts 57 are located at the end of each one of the tubes 41 so that pin 59 can be retracted allowing in part, the boat to be folded as will become clearer from the following discussion, along axis A shown in FIG. 2. When the tension pins 59 are extended by throwing the tension levers 65 the skin fabric 77 is placed in tension and the gunwale chines 33 and gunwale chines 35 with slots, (for the tension levers 65), are interconnected from port to starboard and bow to stern.

Figure 8:
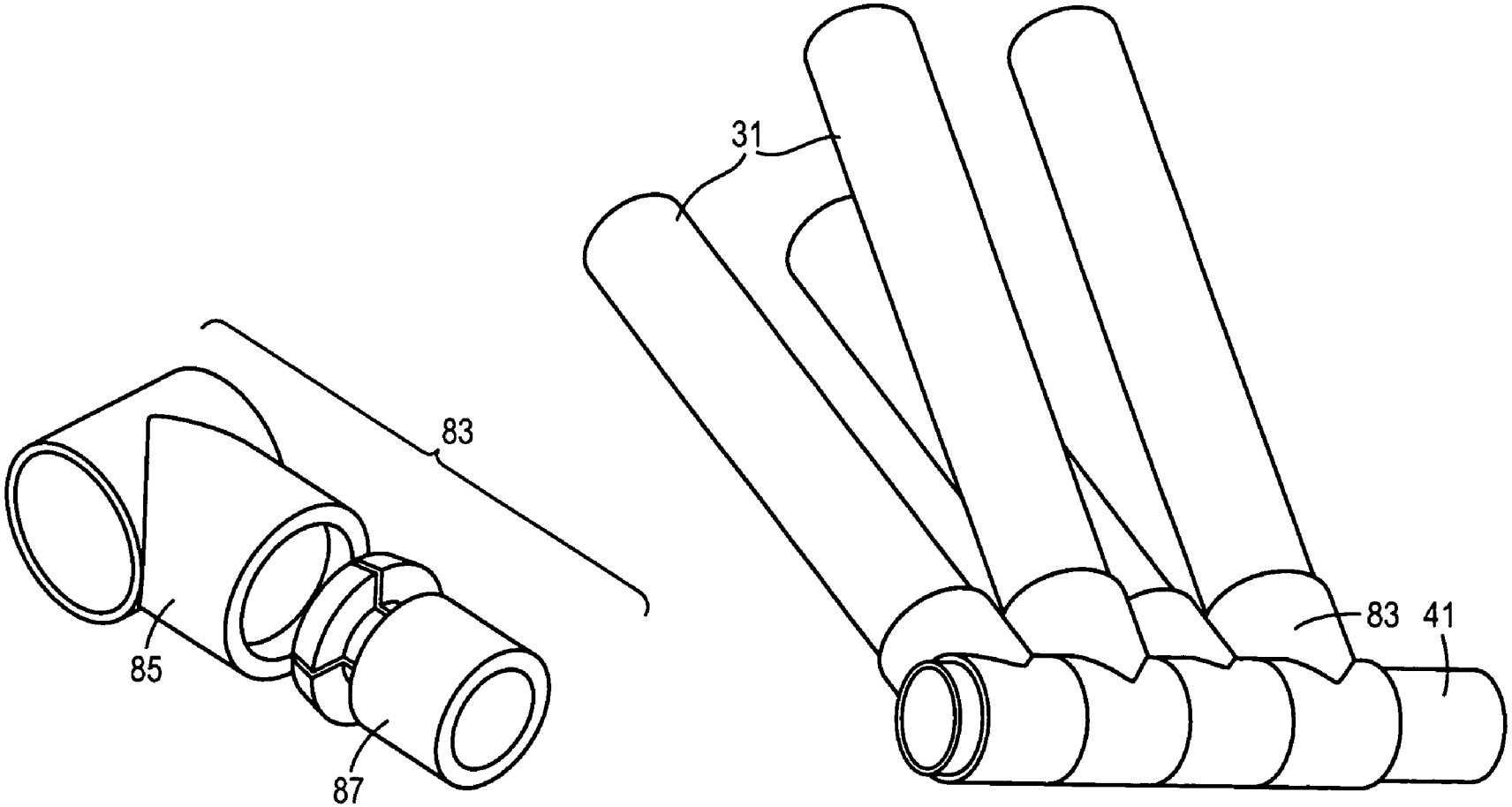
FIG. 8 is detailed view of hollow tube connections at bow and stern allowing movement for proper angles of alignment.

Gunwale chines 33 extend along each side of the boat and are made up of multiple tubes interconnected in a manner similar to other tubular structures of the boat. As more clearly shown in FIG. 8, the connections of hollow tubes 31 to bow and stern tubes 41 is more clearly shown as connection 83 which includes a tubing connector female end 85 and tubing connector male end 87. As may also be appreciated, in addition to gunwale chines 33 and gunwale chines with slots 35, placed specifically for the tension levers 65, to allow receding of the pin mechanism for the bow and stern, there are also provided a plurality of hollow tube chines 31 which connect to the bow and stern as shown in FIG. 8, and also provide a rigid structure at the bottom of the boat by extending in contact with the fabric at the bottom and also extending at the upper portions of the boat to the cockpit tubes 39 be supported by bow and stern spreaders 73 and cockpit spreader 71 shown in FIG. 11. The center cockpit spreader 71 is configured somewhat different from the bow and stern spreaders 73 because it needs to be open to allow an occupant of the boat to be seated in the cockpit. The center spreader is also designed to allow the floorboard(s) 75 to lock all three spreaders into their respective positions. The bow and stern spreaders 73 include hinges 74 allowing unfolding for ease of installation/assembly and folding for ease of carrying in a carrying bag 78 having carrying straps 79 as shown in FIG. 12, and in accordance with the invention.

Figure 6:
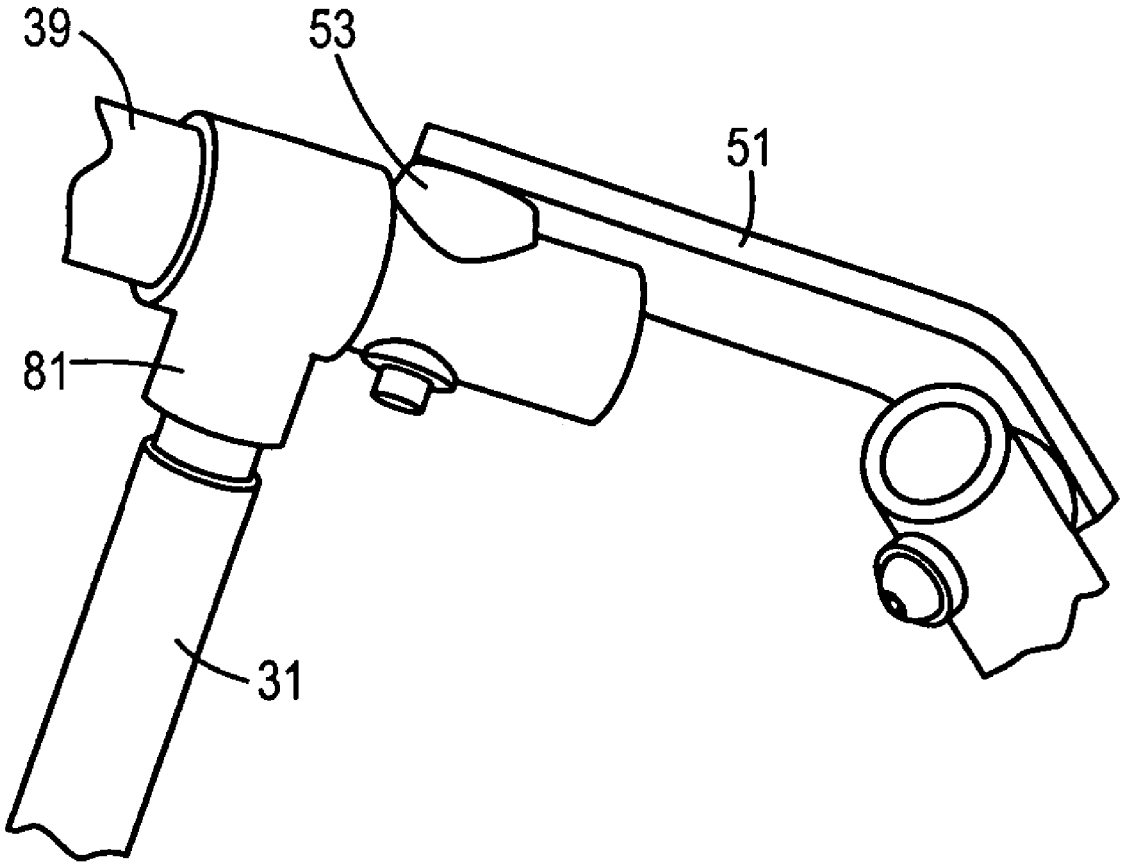
FIG. 6 is an enlarged view of a cockpit tube hinge assembly required to maintain proper angle of alignment for the boat structure.
Figure 10:
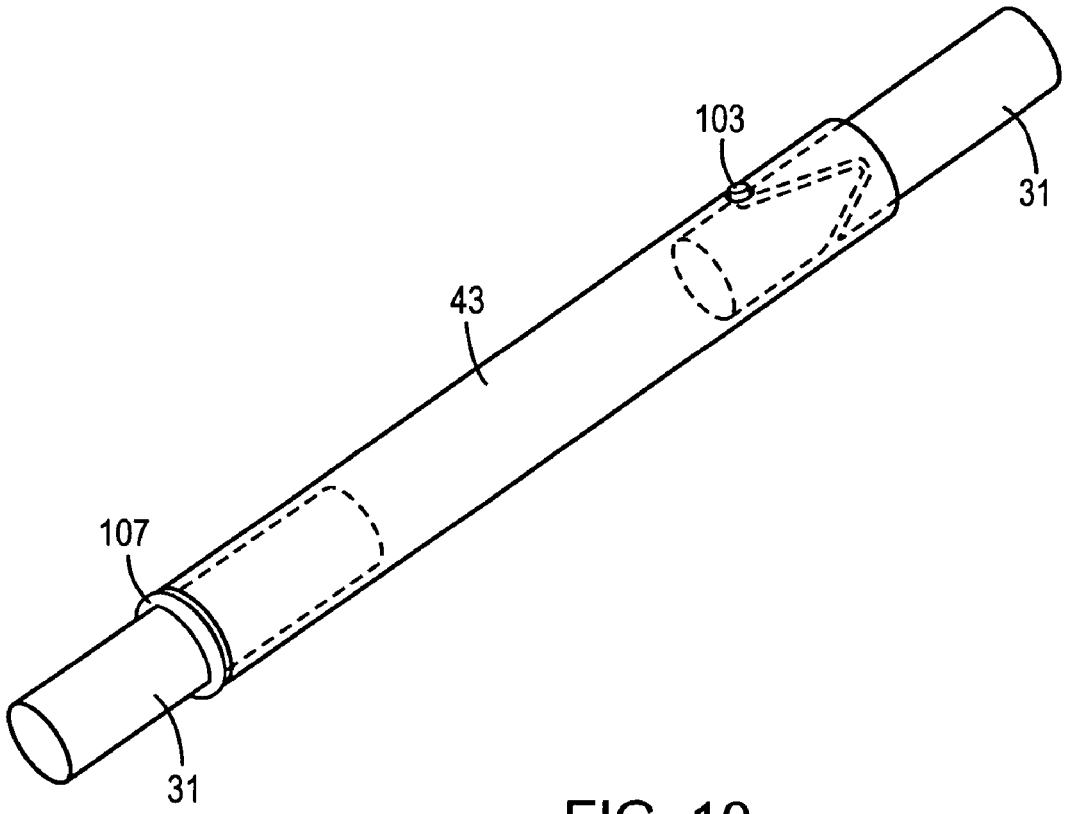
FIG. 10 is a perspective view of the tubing coupler system which provides fabric skin tension from bow to stern and allows the boat to fold along the B axis.

As can also be seen from FIG. 1, and from FIG. 6, there is provided cockpit tubes 39 which include cockpit tube hinges 51 connecting various tubes and defining the cockpit region as an opening through which a user can enter the boat. The hinges 51 allow the cockpit tubes 39 to be folded along the A axis shown in FIG. 2. Connections between tubes of the cockpit tubes 39, which is the same for the gunwale chines and tube chines as shown more clearly in FIG. 10, allow multiple tubes to be disconnected perpendicular to the length of the boat so that the boat can be folded along axis B of FIG. 2.

Figure 3:
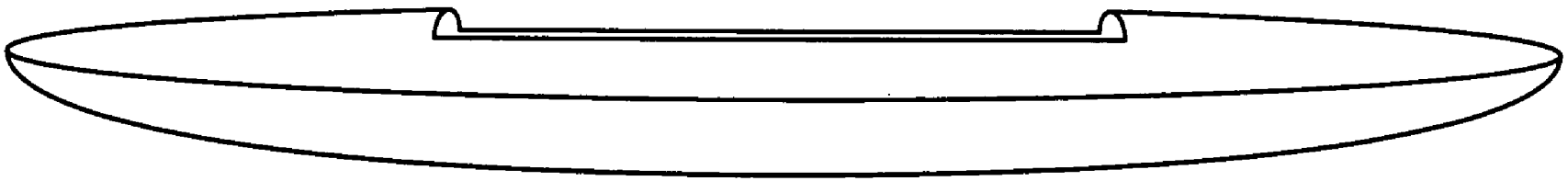
FIG. 3 is a side profile view of the boat in a fully assembled condition.
Figure 4:
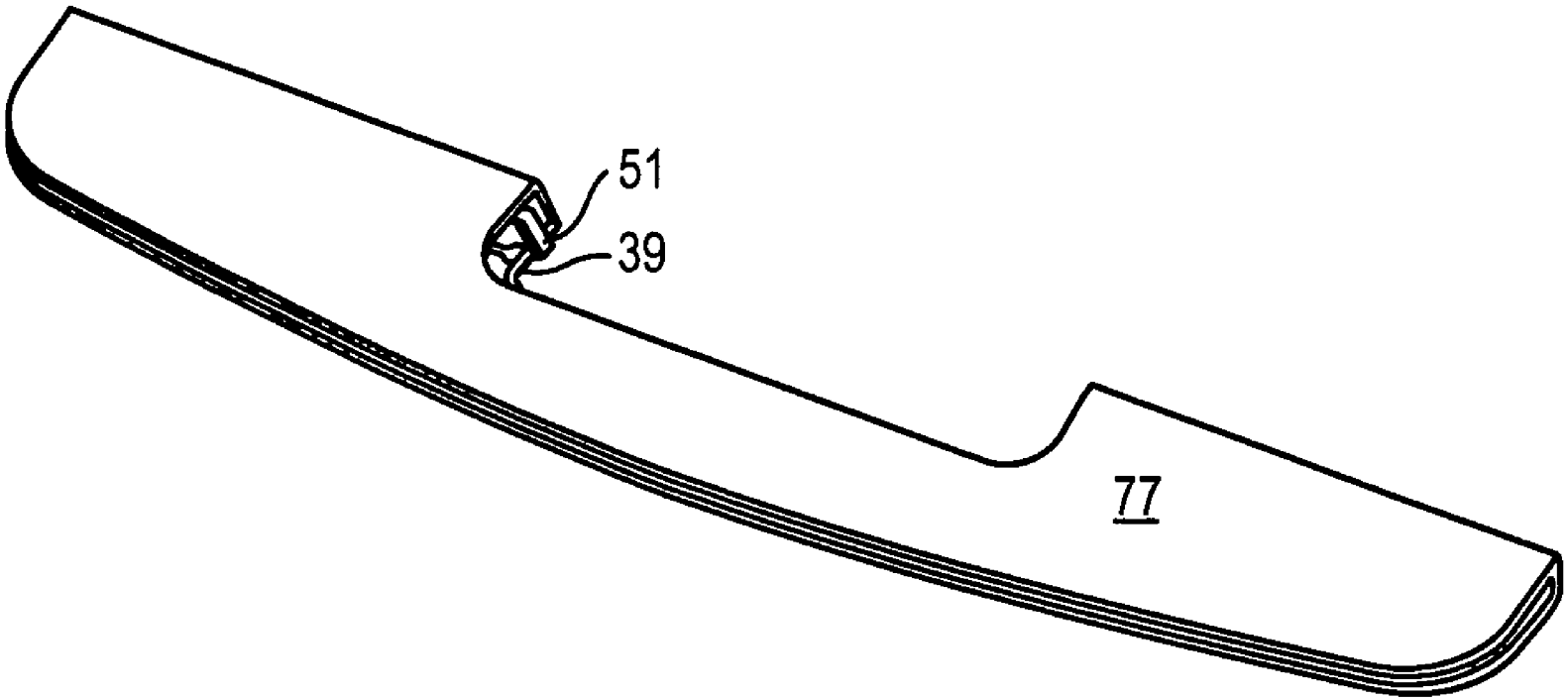
FIG. 4 is a view of the boat folded in half along axis A of FIG. 2.

As may be appreciated, when all elements are interconnected in a rigid form the boat appears as shown in FIG. 3. If the pin 59 at the bow and stern are retracted, the boat, and the cockpit tubes 39 operable with the hinges 51 connected to saddles 53 between the tubes 39 and 31 can be folded, to allow folding of the boat as shown in FIG. 4, which also shows the boat folded with its outer skin fabric 77 on the outside.

Figure 5:
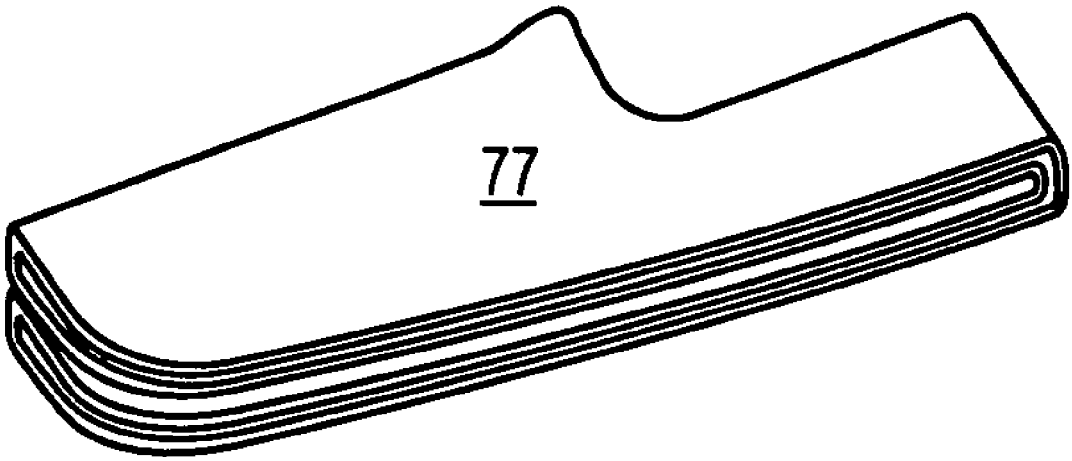
FIG. 5 is a view of the boat folded along both of its axes.

As also previously noted, all of the various tube arrangements are separable by using tubing couplers 43 which are located amidships and which engage with, for example, the hollow tube chines 31 to a stop 107 and a spring button connection 103, allowing separation of tubes amidships and folding of the boat along the second axis B as shown in FIG. 5.

In order to ensure that the various tubes are retained in proper position for assembly, the folding boat of the invention also includes nylon webstrap 81 for tube alignment to spreaders 73 and 71. The nylon webstrap 81 is shown in greater detail in FIG. 6, and illustrates how the various tubes are retained in predetermined positions relative to each other.

Figure 7:
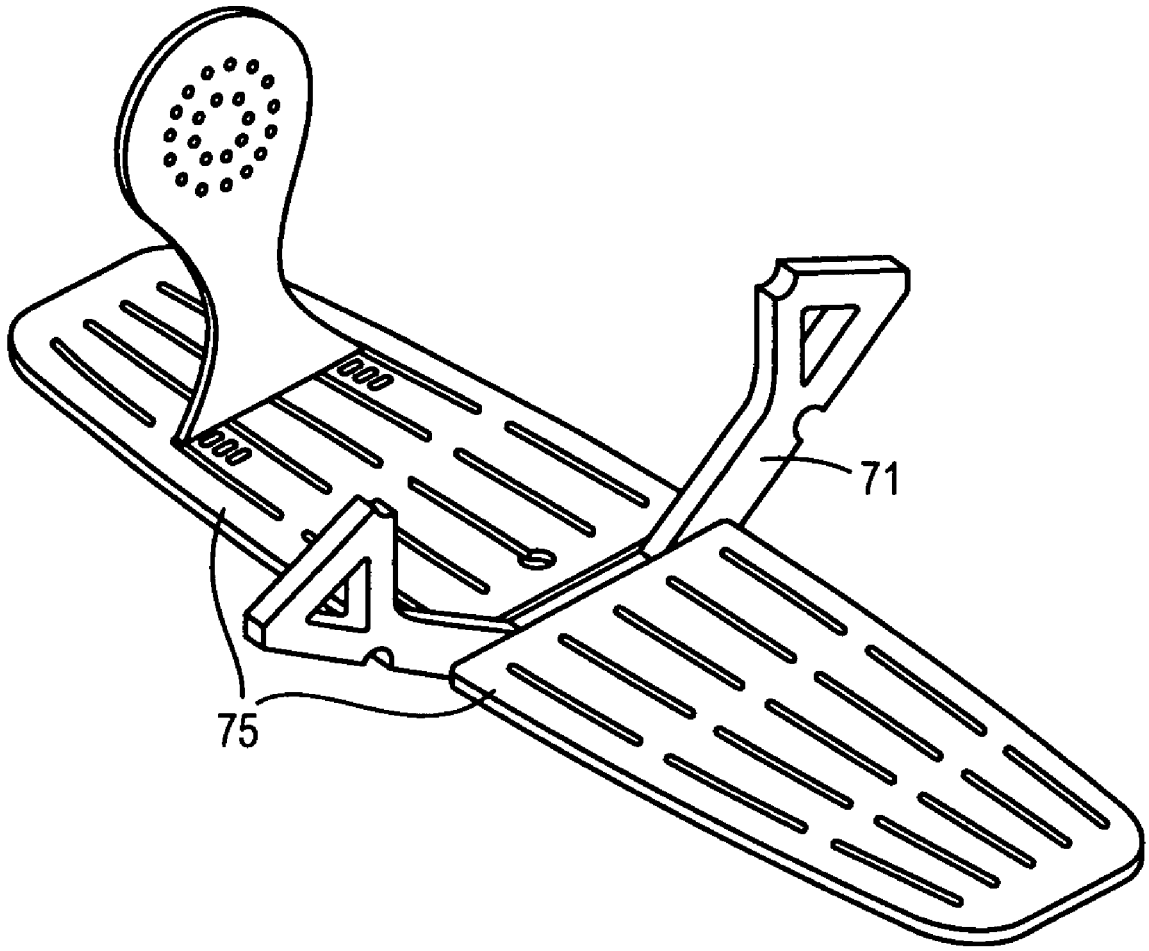
FIG. 7 is a perspective view of the floorboards attached to the center spreader.

The boat in accordance with the invention also includes preferably a pair of floorboards 75, which are received on the floor thereof, once the bow, stern and center spreaders 71 and 73 are received within the boat. The floorboards 75 include an optional seatback for supporting a user's back as shown in FIG. 7.

Figure 11:
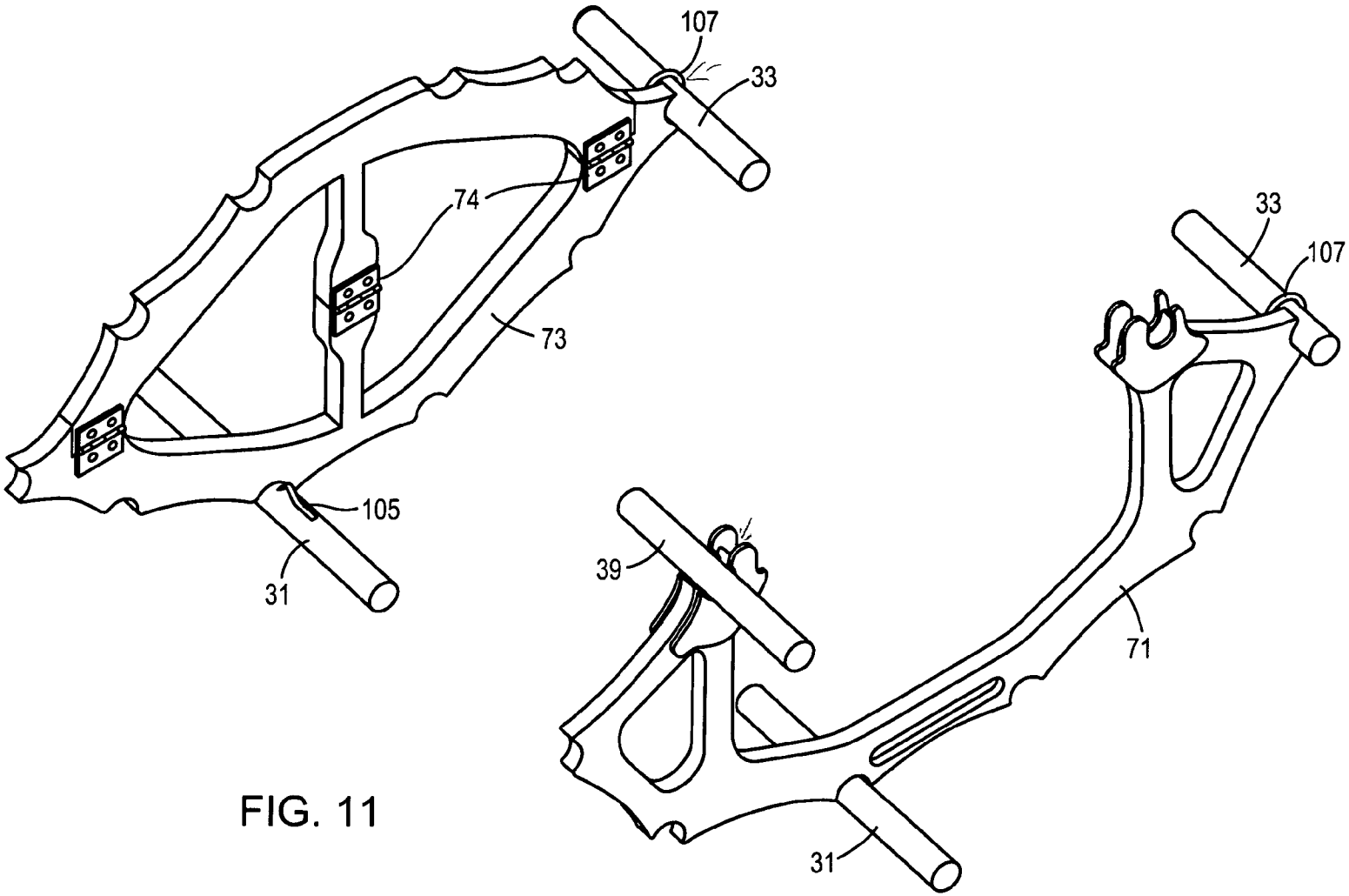
FIG. 11 is a perspective view of the center spreader and bow/stern spreader.
Figure 12:
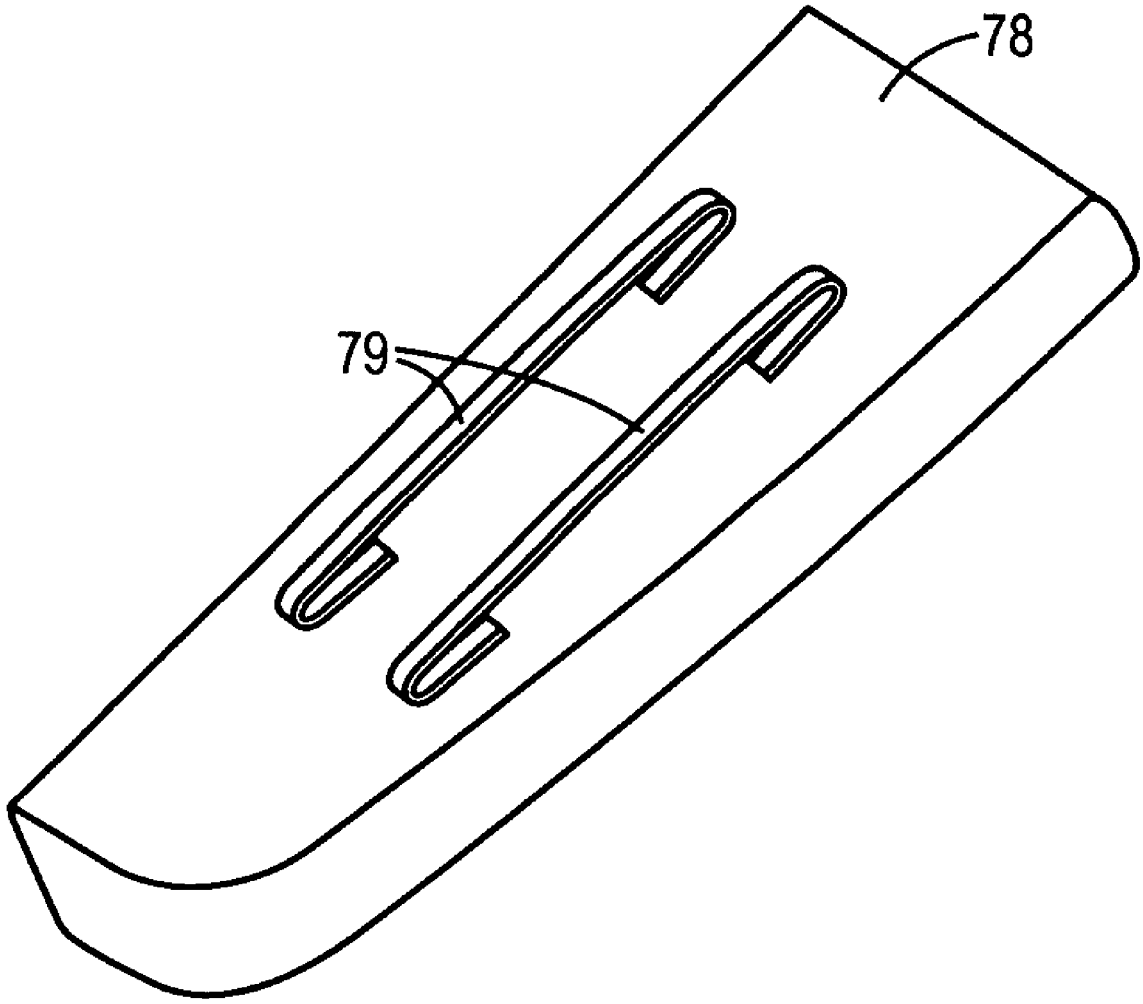
FIG. 12 is a perspective view of the boat folded and contained within a carrying bag.

As further illustrated in FIG. 11, at selected locations on hollow tube chines 31, there are provided spreader spring stops 105 and ring stops 107 to ensure proper positioning of the stern and bow spreaders 73 and center spreader 71 relating to the various tubings. Similarly, both the stern and bow spreader 73 and center spreader 71 include cutout slots for receiving the various tubings of the boat, for example, the gunwale chine 33 and hollow tube chines 31 both along the top sides and the bottom of the spreaders 71 and 73, and also as shown for the cockpit tubes 39.

As will be appreciated by those of ordinary skill in the art, the boat can be made of various light materials. For example, the tube chines 31, gunwale chines 33 and cockpit tubes 39 can be made primarily of lightweight plastic or thin walled metal hollow tubing. The various hinges and other metallic components such as for the spring clip and hinges of the cockpit tubes 39 can be made of light metal selected in accordance with the environment in which the boat is to be used, i.e., salt water or fresh water. The outer skin 77 is waterproof and preferably a lightweight waterproof and durable skin fabric which when all elements of the boat are in the extended position, is tight and provides a stable boat platform.

Having thus generally described the invention, the same will become better understood from the appended claims in which it is set forth in a non-limiting manner.

What is claimed is:

1. A folding boat, comprising:

bow and stern members, each comprised of a pair of tubes connectable to each other through a pin engaging mechanism, said pin mechanism being actuatable for engaging the pair of tubes to each other and for providing tension to a waterproof fabric skin which is part of the boat;

a pair of gunwale chines extending the length of the boat at each side thereof, said gunwale chines having multiple segments engageable with each other and separable from each other;

a plurality of tube chines extending the length of the boat, along a floor thereof, and elevated from the floor thereof, each one of said tube chines having multiple segments engageable with each other and separable from each other;

cockpit tubes engageable with each other and moveable in relation to each other for defining a cockpit entry a bow spreader, a stern spreader, and center cockpit spreader, each configured for supporting and retaining said gunwale chines tube chines and cockpit tubes in a spread and fixed position;

at least one floor board removable from the boat and configured for placing on a floor cockpit region and for being retained by said bow spreader and stern spreader; and a waterproof fabric skin supported by and surrounding said bow and stern members, gunwale chines, tube chines, cockpit tubes, bow spreader, stern spreader and floor boards, when engaged, in a tensioned condition, and when not engaged for allowing the boat to be folded along two axis within the waterproof skin.

2. The boat of claim 1, wherein said cockpit tubes are hinged with respect to each other.

3. The boat of claim 1, wherein said pin engaging mechanism comprises tension pin inserts connected to provide a hinge which when moved, moves the tension pin inserts into engagement between pairs of tubes, each making up the bow and stern members for engagement in a rigid condition.

4. The boat of claim 1, wherein said waterproof skin is a waterproof fabric.

5. The boat of claim 1, wherein said bow and stern members, gunwale chines, tube chines and cockpit tubes are made of tubing.

6. The boat of claim 5, wherein said waterproof skin further comprises skin sleeves for receiving and holding the flexible plastic tubing of the boat engaged therewith in position for assembling the boat from a folded condition.

7. The boat of claim 6, wherein said at least one floor board is removable from inside the boat.

8. The boat of claim 1, further comprising a removable seat attachable to the at least one floor board within the cockpit.

9. The boat of claim 1, wherein said at least one floor board is removable from inside the boat.

10. The boat of claim 1, further comprising a carrying bag for carrying the boat when folded along two axes.

* * * * *